US011844993B1

(12) United States Patent
Parrilla

(10) Patent No.: US 11,844,993 B1
(45) Date of Patent: Dec. 19, 2023

(54) PHYSICAL WORKOUT SYSTEM AND METHOD

(71) Applicant: Marco A Parrilla, Lorain, OH (US)

(72) Inventor: Marco A Parrilla, Lorain, OH (US)

( * ) Notice: Subject to any disclaimer, the term of this patent is extended or adjusted under 35 U.S.C. 154(b) by 0 days.

(21) Appl. No.: 17/974,144

(22) Filed: Oct. 26, 2022

Related U.S. Application Data

(63) Continuation-in-part of application No. 17/726,137, filed on Apr. 21, 2022, now abandoned.

(60) Provisional application No. 63/418,794, filed on Oct. 24, 2022, provisional application No. 63/177,499, filed on Apr. 21, 2021.

(51) Int. Cl.
*A63B 71/02* (2006.01)
*A63B 21/16* (2006.01)

(52) U.S. Cl.
CPC ..... *A63B 71/022* (2013.01); *A63B 21/169* (2015.10); *A63B 71/023* (2013.01); *A63B 2225/105* (2013.01)

(58) Field of Classification Search
CPC ... A63B 71/022; A63B 21/169; A63B 71/023; A63B 2225/105
See application file for complete search history.

(56) References Cited

U.S. PATENT DOCUMENTS 3,948,513 A * 4/1976 Pfotenhauer ..... A63B 17/04 482/142
4,306,715 A * 12/1981 Sutherland ..... A63B 21/078 482/104
4,408,759 A * 10/1983 Reneau ..... A63B 21/4045 482/114
4,415,150 A * 11/1983 Iezza ..... A63B 3/00 248/165
4,729,561 A * 3/1988 Desjardins ..... A63B 21/078 482/104
4,856,773 A * 8/1989 Deola ..... A63B 21/0626 482/102
4,955,604 A * 9/1990 Pogue ..... A63B 21/0783 482/99
5,082,260 A * 1/1992 Dinelli ..... A63B 21/4029 482/104
5,286,241 A * 2/1994 Petrakis ..... A63B 69/222 482/83
5,306,220 A * 4/1994 Kearney ..... A63B 23/00 482/99
5,346,448 A * 9/1994 Sollo ..... A63B 21/00181 482/99
7,070,546 B1 * 7/2006 Grasso ..... A63B 21/072 482/145

(Continued)

*Primary Examiner* — Garrett K Atkinson
(74) *Attorney, Agent, or Firm* — Bodi Law LLC

(57) ABSTRACT

A modular and configurable muscular physical rehabilitation and training system that is a total body fitness system designed to promote strengthening and creation of muscle mass using free weights. Free weights simulate real-life situations and promote whole body stabilization. Free weights allow more variations in the range of motion than using modern machines. The system allows the flexible and configurable use of muscle contractile activities utilizing free weights and proper techniques. This is done in a space-saving, compact, safe, configurable, and practical configuration that can be used with a plurality of participants supported by a single trainer/therapist.

21 Claims, 10 Drawing Sheets

(56) References Cited

U.S. PATENT DOCUMENTS

| | | | | |
|---|---|---|---|---|
| 7,374,516 | B2 * | 5/2008 | Lundquist | A63B 21/0783 482/106 |
| 7,731,631 | B2 * | 6/2010 | Collias | A63B 21/0783 482/38 |
| 9,289,638 | B2 * | 3/2016 | Towley, III | A63B 21/00047 |
| 10,967,218 | B2 * | 4/2021 | Murrell | A63B 17/00 |
| 11,110,313 | B2 * | 9/2021 | Gore | A63B 21/0783 |
| 11,446,535 | B1 * | 9/2022 | Iverson | A63B 21/169 |
| D992,063 | S * | 7/2023 | Dunahay | D21/686 |
| 2008/0139367 | A1 * | 6/2008 | Cooper | A63B 71/022 482/83 |
| 2015/0065316 | A1 * | 3/2015 | Towley, III | A63B 21/078 482/104 |
| 2021/0178243 | A1 * | 6/2021 | Colling | A63B 71/022 |
| 2022/0323815 | A1 * | 10/2022 | Simental | A63B 21/0557 |
| 2023/0114752 | A1 * | 4/2023 | Dery | A63B 21/16 482/148 |

* cited by examiner

PHYSICAL WORKOUT SYSTEM AND METHOD

CROSS-REFERENCES TO RELATED APPLICATIONS

This application is a continuation-in-part of U.S. patent application Ser. No. 17/726,137 filed on Apr. 21, 2022, which claims the benefit of U.S. Provisional application Ser. No. 63/177,499 filed on Apr. 21, 2021. This application also claims the benefit of U.S. provisional application Ser. No. 63/418,794, filed on Oct. 24, 2022. All of which are incorporated herein by reference.

BACKGROUND

This application relates generally to an exercise apparatus and method of use.

Conventional approaches for exercise equipment, in particular weightlifting equipment, fail to provide an integrated approach that is conducive to effective use while efficiently utilizing space. Current systems also do not utilize therapists/trainers in an efficient manner, and are inflexible and not adaptable to easy reconfiguration. A solution to these problems is desired.

SUMMARY

Provided are a plurality of example embodiments, including, but not limited to, the configurable embodiments shown in the attached figures. Due to the reconfigurable nature of the system, an almost limitless range of embodiments can be supported.

Also provided is a method of providing training or a therapy to a plurality of participants, said method comprising the steps of: providing a modular physical rehabilitation system comprising a plurality of configurable units, each one of said configurable units being configured to be placed adjacent to another one of said configurable units, wherein each one of said configurable units can be configured to support one or more of said participants with exercise equipment including free weight support, and provide therapy and/or training to each one of said participants in a concurrent manner using one or more therapists/trainers.

Further provided is the above method wherein each one of said configurable units includes at least 2 (front) exercise stations on a longitudinal side and at least one (side) exercise station on a transverse side, using a single unit. Adding an additional unit can double the number of stations.

Still further provided are any of the above methods wherein at least one of said exercise stalls is configurable with equipment including free weights for performing any of bench presses, squats, shoulder presses, curls, stationary biking, bent rows, and shoulder shrugs.

Even further provided are any of the above methods wherein a side exercise station is configurable with equipment for performing dip station/chin ups.

Further provided is a system to provide training and/or a therapy to a plurality of participants, comprising: a cage having a frame including: a front beam, a back beam, a first side beam connected to said front beam and said back beam on one side of the cage, and a second side beam connected to said front beam and said back beam on another one side of the cage, a first front leg attached at or near a junction of said front beam and said first side beam, a second front leg attached at or near a junction of said front beam and said second side beam, at least one sliding leg configured to slide along the front beam and be temporarily secured at one of a plurality of potential locations along that front beam; and at least one adjustable and movable exercise stations configured to mount on one or more of said legs.

Still further provided is a system to provide training and/or a therapy to a plurality of participants, comprising: a cage having a frame including: a front beam, a back beam, at least one wall beam connected to said back beam, said at least one wall beam being configured for attaching to a wall, a first side beam connected to said front beam and said back beam on one side of the cage, and a second side beam connected to said front beam and said back beam on another one side of the cage, a first back leg connected at or near a junction of said first side beam with said back beam, said first back leg being configured for fixedly connecting to a floor; and a second back leg connected at or near a junction of said second side beam with said back beam, said second back leg being configured for fixedly connecting to the floor; a first front leg attached at or near a junction of said front beam and said first side beam, said first front leg being configured for fixedly connecting to the floor, a second front leg attached at or near a junction of said front beam and said second side beam said second front leg being configured for fixedly connecting to the floor, at least one pair of sliding legs, each sliding leg being configured to slide along the front beam and be temporarily secured at one of a plurality of potential locations along that front beam; a plurality of adjustable and movable exercise stations each configured to mount on one or more of said legs, wherein at least one of said adjustable and movable exercise stations is configured for a different exercise than another one of said adjustable and movable exercise stations.

Also provided is a method using any of the above systems for providing training and/or a therapy to a plurality of participants, said method comprising the step of providing therapy or training to each one of said participants in a concurrent manner using the system with one or more therapists/trainers supporting said training/therapy.

Still further provided are additional example embodiments, some, but not all of which, are described hereinbelow in more detail.

BRIEF DESCRIPTION OF THE DRAWINGS

The features and advantages of the example embodiments described herein will become apparent to those skilled in the art to which this disclosure relates upon reading the following description, with reference to the accompanying drawings, which show the various components of the system in substantial detail, including.

DETAILED DESCRIPTION OF THE EXAMPLE EMBODIMENTS

This system includes various improvements to the Squat Rack disclosed in U.S. Pat. No. 7,635,322, issued on Dec. 22, 2009, and incorporated herein by reference in its entirety. Also incorporated herein is an application to a Suspended Squat Rack as disclosed in U.S. Pat. No. 7,025,712 filed on Sep. 5, 2002. This application also incorporates the entire disclosure, drawings, and appendices of U.S. provisional patent application Ser. No. 63/177,499 filed on Apr. 21, 2021 and U.S. provisional patent application Ser. No. 63/418,794, filed on Oct. 24, 2022.

Provided is a muscular physical rehabilitation system that is a total body fitness system designed to promote strengthening and creation of muscle mass using free weights. Free weights simulate real-life situations and promote whole body stabilization. Free weights allow more variations in the range of motion than using modern weight lifting machines. The system allows the use of muscle contractile activity utilizing free weights and proper techniques. This is done in a space-saving, compact, safe, stable, and practical configuration as disclosed herein.

One modification to the '322 disclosure is the addition of a configurable cage. The addition of the new leg rolling system and locking devices (pins) in conjunction with the locator holes in the I beam(s) the frame to match up with the locking pins on roller assemblies attached to a top portion of the linearly movable legs will reduce the risk and guess work in finding the right locations between shoulder width and Olympic size exercises. This variation of rollers on both sides of the bottom lip of the I-Beam adds to the smoothness of reconfiguration of exercises.

Improved additions are the wall supports, and supports that attach system to system, back to back for integrating two cages (units) into a larger workout system capable of supporting multiple patients. Attaching the cage system to the floor was another addition to add to the stability and sturdiness of the system.

Figure 1:
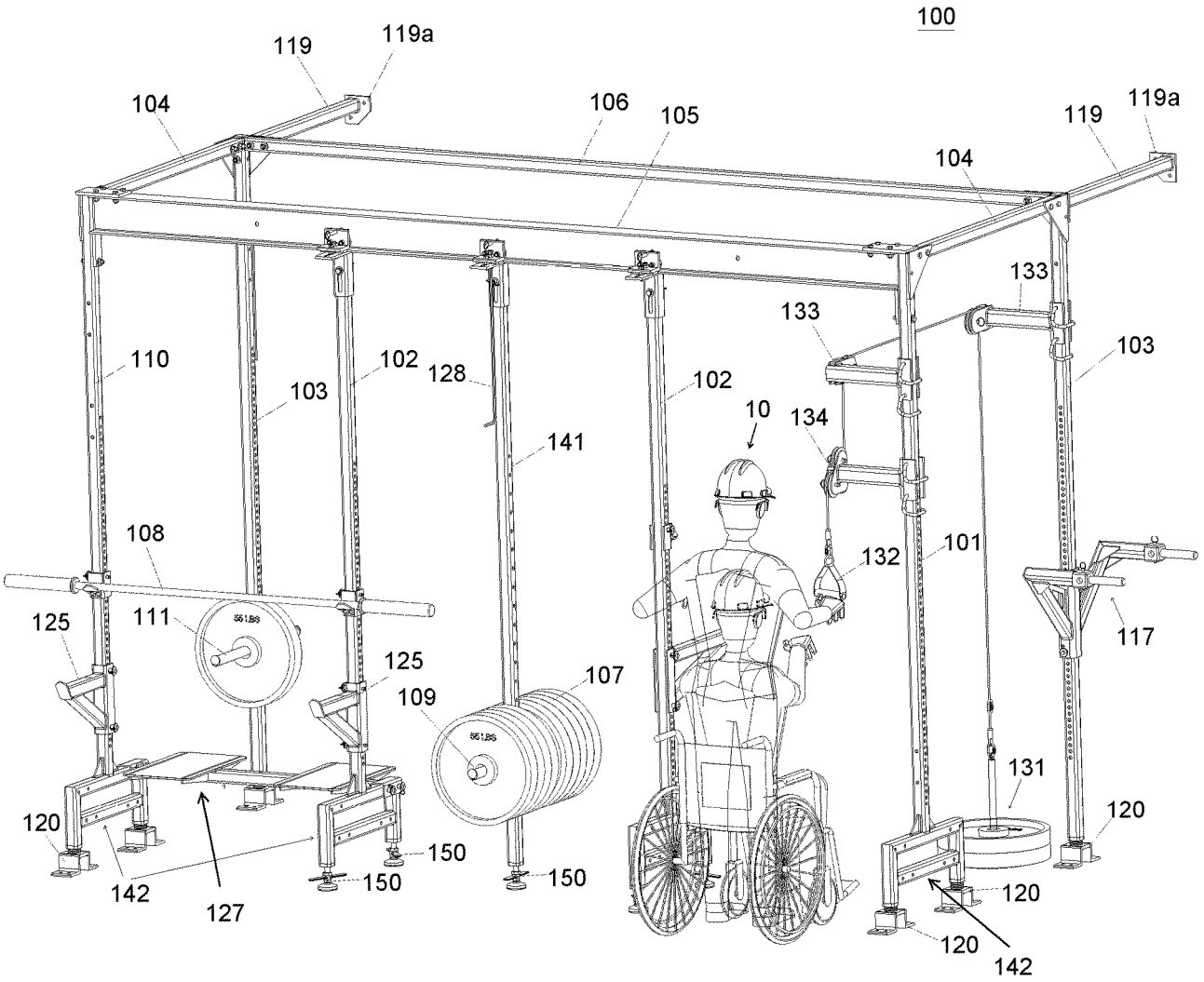
FIG. 1 shows a perspective view of an example single unit being used by a user.
Figure 2:
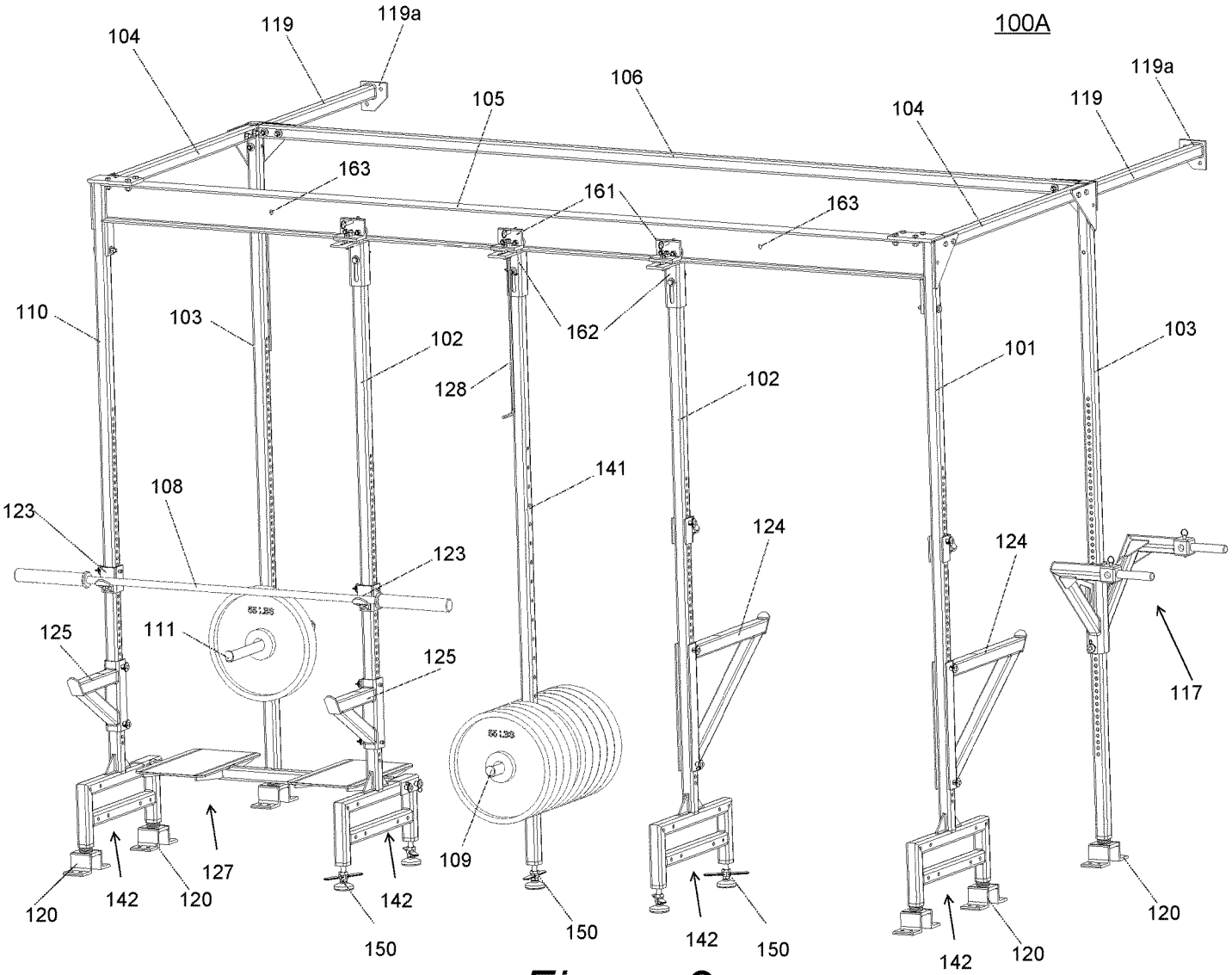
FIG. 2 shows a perspective view of an example single unit with a different configuration.

A single unit (cage), such as shown in FIGS. 1 and 2, provides several variations of rehabilitation exercises. For example, three or more exercise stations can be set up configured for the individuals unique size, such as to accommodate whole-body workouts. A single system can be configured for use by three different users, or for circuit training a single user. Also provided is a one-dip and a chin-up station.

Figure 8:
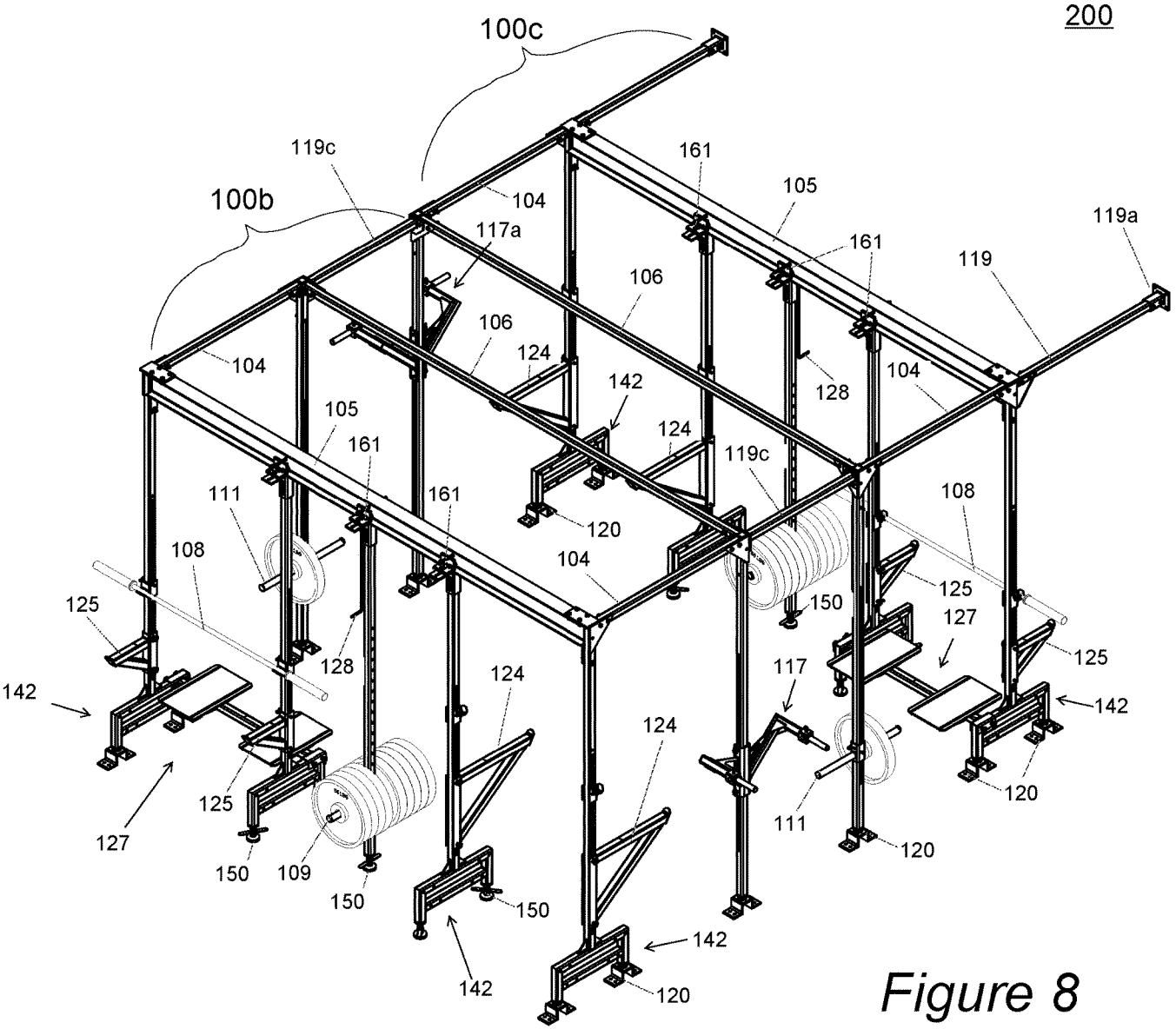
FIG. 8 shows a perspective view of an example system comprising a pair of the units of FIG. 2 configured together to form a larger system having a different exercise station configurations.

By adding a second unit with the first unit, back to back, as shown in FIG. 8, the system can be configured to accommodate an additional three or more stations with six total exercise stations. FIG. 1 shows a single participant using the system, but up to six or more could be accommodated with the dual unit configuration. Each unit can be provided of example dimension 5 ft. deep, 12 ft. wide, and 100 inches tall. The dual unit could then be approximately 10 feet deep.

The system is comprised of hangers with safety hooks that allow the user to roll and create individual workstations for shoulder-width exercises, up to Olympic size exercises. The design allows for ease of re-configuration, and substantial flexibility in station design. The exercise stations can be mixed and matched as desired, using unique or duplicate stations in various adjustable configurations. This allows for generous flexibility and variability in the exercises to be supported.

For example, there can be provided 2 exercise stalls on the longer (longitudinal) front or back side of the cage which permit two areas to do bench presses (all variations), squats, shoulder press, curls (shoulder width), stationary bike, bent rows, shoulder shrugs, all with free weights. Two or more side stations (transverse side) can be provided that can have 2 bench press stations or other exercise stations at the same time. The side stations offer, for example, two exercises, dip station/chin ups section. Or side stations can be moved to the front/back stations, and vice versa.

By the addition of a second caged unit, the number of stations can be doubled, and one can have up to 6 or more physical therapy patients being rehabilitated at the same time with the assistance of an on site physical therapist. One target market is the physical therapy market, and eventually into physical fitness. This system provides the physical therapy market with a practical, flexible, and customizable free weight system for performing physical therapy and fitness.

From the exercise stand-point, one can set up one single unit with 3 or 4 different exercises (with each supporting a separate participant) and be utilized as a circuit training device. A spotter can change exercises and keep the lifter in constant mode to reach total muscle failure. Adding a second unit will expand the system to support additional stations, as would adding a third unit, or more.

This system could be utilized as a Freeweight P.T. device that would be considered a physical therapy device, that will utilize one or more licensed physical therapists to assist in process of free weight physical rehabilitation. One Free Weight P.T. (one unit) can rehabilitate up to 3 patients at the same time. If a second device (unit) is installed back to back to another Freeweight P.T. device, one could rehabilitate up to 6 patients, with a constant changing of exercises by the physical therapist.

Freeweights are very beneficial for rehabilitation for simple reason that it makes the patient lift, control, and balance the weight, improving on all of those capabilities through practice and training.

The Freeweight P.T. device need not be a heavy load bearing device, but rather a device that can be utilized for teaching the patient the full range of motion, and science behind lifting weights for rehabilitation that will stay with the patient for a full recovery or perhaps stronger than before for the rest of the patient's life.

FIGS. 1 and 2 show a first perspective view of a single unit system 100, 100A to be used by a patient 10. This system is comprised of a cage frame having front beam 105, back beam 106, and side beams 104 connecting the front beam 105 to the back beam 106 on alternate sides. The cage includes front legs 101, 102, 110, and center front leg 141, and two back legs 103 for supporting the beams 104, 105, and 106 along with the equipment used at the exercise stations. As shown, the legs 103 have a fixed foot bracket 120, whereas legs 101, 102, and 110 have a bottom post stand 142 provided for additional stability. Some of the bottom post stands 142 utilize fixed foot brackets 120, whereas center front leg 141 and other bottom post stands 142 utilize adjustable foot brackets 150 to adjust the unit for uneven surfaces and/or warping and bowing.

Note that the fixed brackets 120 are on the legs and posts found at sides (and back) of the unit, and can be provided with a pair of holes in their base to secure them to the floor using securing hardware (e.g., slag bolts or screws). These legs 101, 110, 103 are permanently connected to the respective beams 104, 105, 106 using brackets and bolts. The adjustable brackets 150 are typically put on the inner legs and posts, with the inner legs 102, 141 being sliding legs that are slidable in the horizontal direction along front beam 105 until being secured to the front beam 105 using a locking pin on bracket 161 to engage a hole in the front beam 105, discussed in more detail hereinbelow. The top frame includes the front beam 105, a back beam 106, side beams 104, and mounting beams 119 each connected to a wall mounting bracket 119*a*.

All of the legs and beams could be provided at any desired lengths for various implementations. Generally, the height of the example assembled and installed single unit is about 5 ft. deep, 12 ft. wide, and 100 inches tall. Alternative dimensions are easily accommodated by changing the lengths of the various beams and legs, and/or by using extension brackets and braces.

The legs are outfitted with various holes that can be utilized with the optional, movable components described herein. This allows multiple devices to be installed on the legs, and it allows the devices to be moved vertically up-and-down to change their effective height, such as to customize device placement to the needs of individual users, such as taller versus shorter users. These components can be mounted using pins, screws, or other fasteners to hold them in place in a removable manner. The figures show these holes in various configurations that could be modified as desired for alternative embodiments.

Note that the various legs and beams are connected together using braces and connecting hardware. The particular types of such hardware could be any effective components known in the art or developed in the future. The various components can be constructed of a strong material, such as steel, steel alloys, composite materials, or other materials that can sustain the types and quantities of weight that are used in the training operations to be supported. For example, the legs at the left and right ends of the device (front and back) can be fixedly connected to the beams, such as at, or near, junctions in the beams themselves. The figures show the connections at the junctions of the front beam 105 and the side beams 104 (left and right front legs 110, 101), and at the junctions of the back beam 106 and the side beams 104 (left and right back legs 103). However, the legs could be mounted on only the side beams, or the front/back beams, as desired, although for structural purposes it is suggested that they be mounted near the cross beams. Examples of such hardware and additional components for use with the system are provided in the disclosure, drawings, and/or appendices of U.S. provisional patent application Ser. No. 63/177,499; and U.S. provisional patent application Ser. No. 63/418,794; both incorporated herein by reference.

Figure 12:
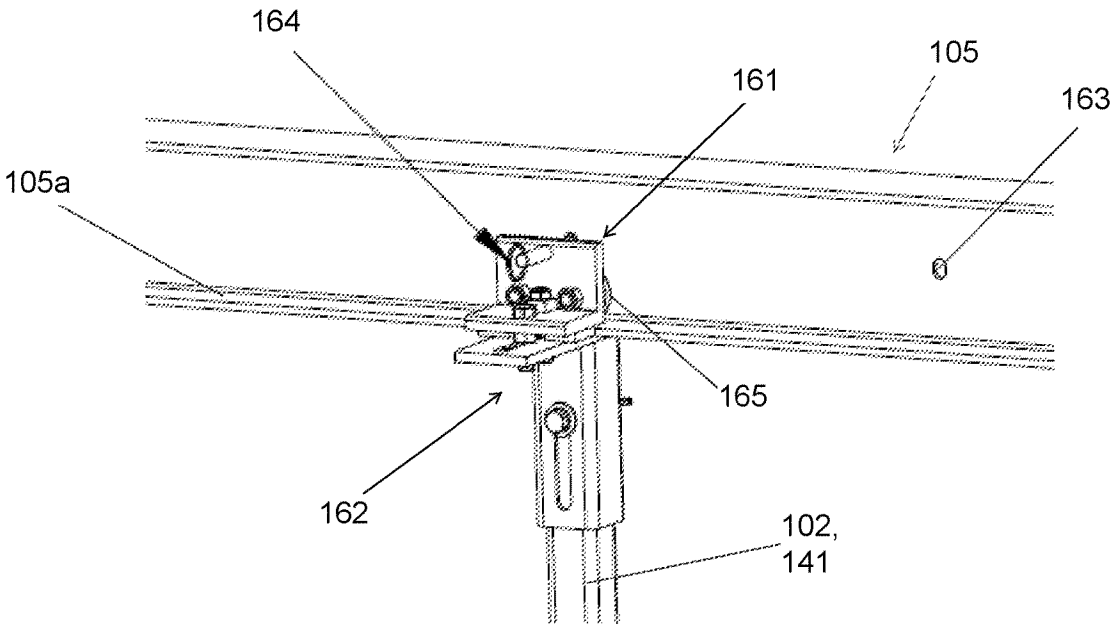
FIG. 12 is a view of an example configuration of a slidable mounting bracket for use by movable legs of any of the example systems.

Of particular note in an example embodiment, the front beam 105 is comprised of an "I" beam having holes 163, a top lip, and a bottom lip 105*a* as shown in FIG. 12. Although the example front beam is shown with 5 holes, more holes can be added (e.g., 6, 7, 8, 9, 10 or more) to refine the ability to adjust the space between the adjustable legs 102, 141. The adjustable (moveable) legs 102, 141 have a bracket 162 that is connected via connector hardware (e.g., a bolt) to a bracket 161 that is configured to slide along the lip 105*a* and that is secured by using a locking pin 164 that engages one of the holes 163 to hold the bracket 161, and thereby the legs 102, 141 in place. Removing the pin allows the leg to be "rolled" along the beam 105 to move the leg's horizontal position. As suggested above, the number of holes 163 can be increased, as desired, to support more finely adjustable legs in the horizontal position, as desired. The number of adjustable legs could also be increased, if desired, to greater than 3 (or reduced to 1 or 2). This allows accommodation of differently spaced equipment, such as longer weight barbells to support users with wider shoulders, for example.

Figure 13B:
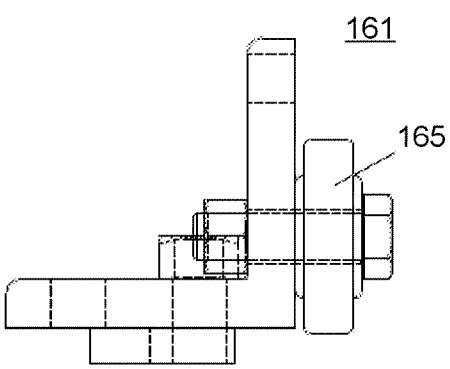
FIGS. 13A and 13B show different perspectives of an example bracket with wheels for use in the mounting bracket of FIG. 12.
Figure 13A:
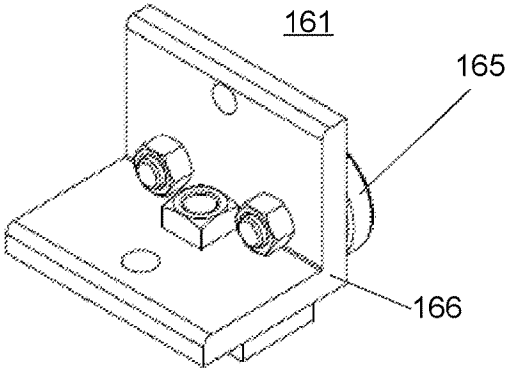

The example bracket 161 is shown in FIGS. 13A and 13B with one of pair of wheels 165 and a corner bracket 166 along with connecting hardware (bolts and nuts). The wheels 165 allow the legs connected to the respective brackets 161 to slide along the beam 105 for adjusting. By adding additional holes 163, the placement of the legs 102, 141 are adjustable along the length of the beam 105. The wheels 165 can utilize any rubber, plastic, or metal wheel that may utilize bearings to facilitate movement. In some cases, a single wheel may be used instead of a pair, or rollers could be used instead of wheels, for example.

The example systems provide a plurality of exercise workstations and components for training and rehabilitation purposes, including a dip station assembly 117 installed on one of the legs 103. Note that any station could be installed on other legs, as desired.

An optional pulley weight system is shown installed in unit 100 of FIG. 1 having upper pulleys 133 installed on the right side of the unit on legs 103, 101 respectively, with lower pulley 134 installed on leg 101. The pulley system has a handle 132 at one end and a weight rack 131 at the other end for weight training. Alternatively, unit 100A of FIG. 2 shows a unit having a pair of large weight/squat catches 124 installed on legs 101 and 102, respectively, rather than the pulley weight system.

A pair of weight catchers 125 are installed on legs 110, 102 at the front of unit 100, and are associated with a free weight barbell 108 held by a pair of barbell hangers 123 with a spotter bench 127 installed therewith to form an adjustable squat rack subsystem. Weight hanger 111 is provided to hold weights for the barbell 108. A weight post storage assembly 109 is provided installed on leg 141 to store additional weights for use by the free weight components of the system.

Figure 3:
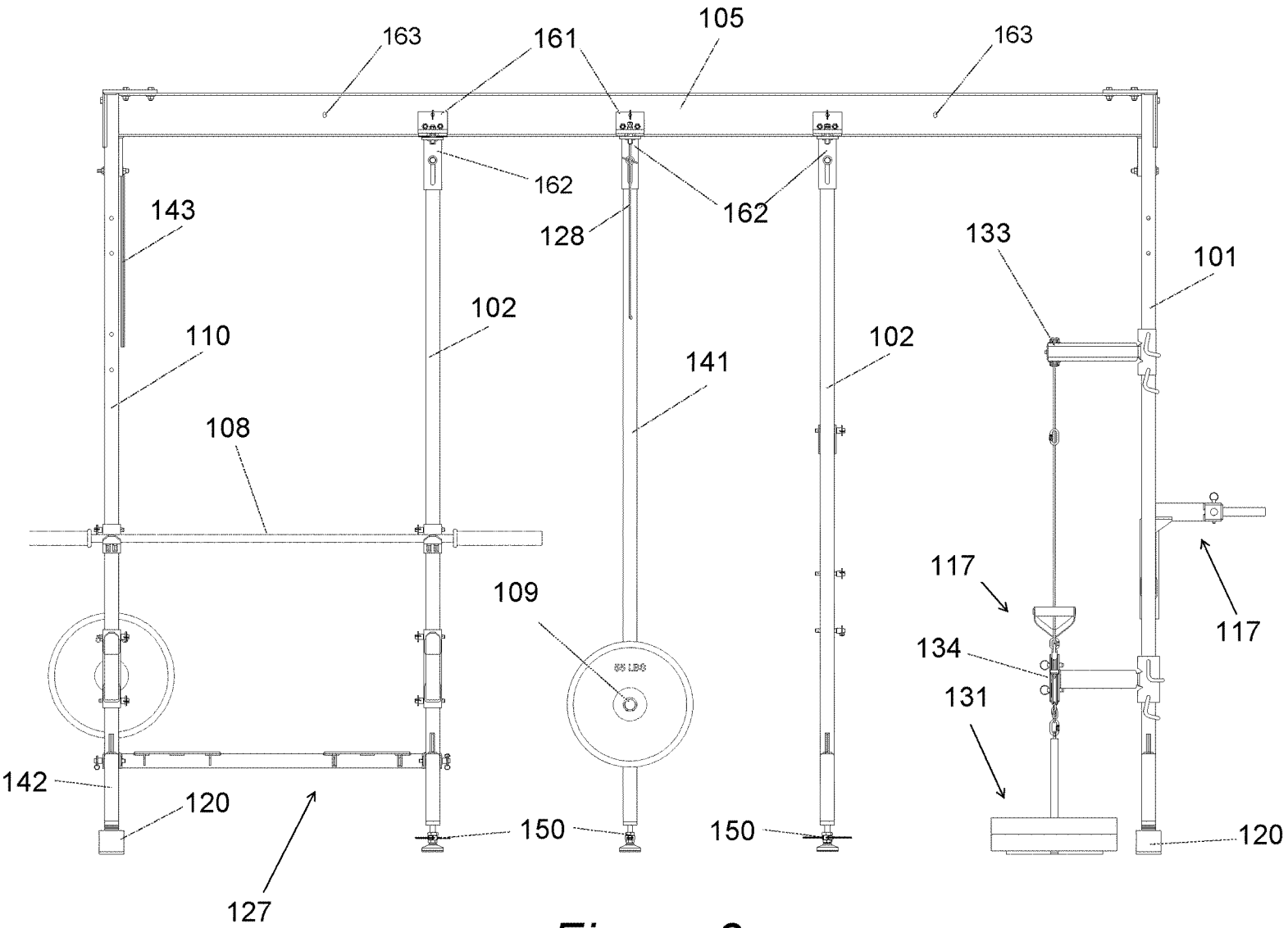
FIG. 3 shows a front view of the example single unit of FIG. 1.

FIG. 3 shows a front view of the unit 100 of FIG. 1. Note the wrench 143 for adjusting various fasteners can be hung from a hole in the leg 110, or other legs, and a different wrench 128 is shown on leg 141.

Figure 5:
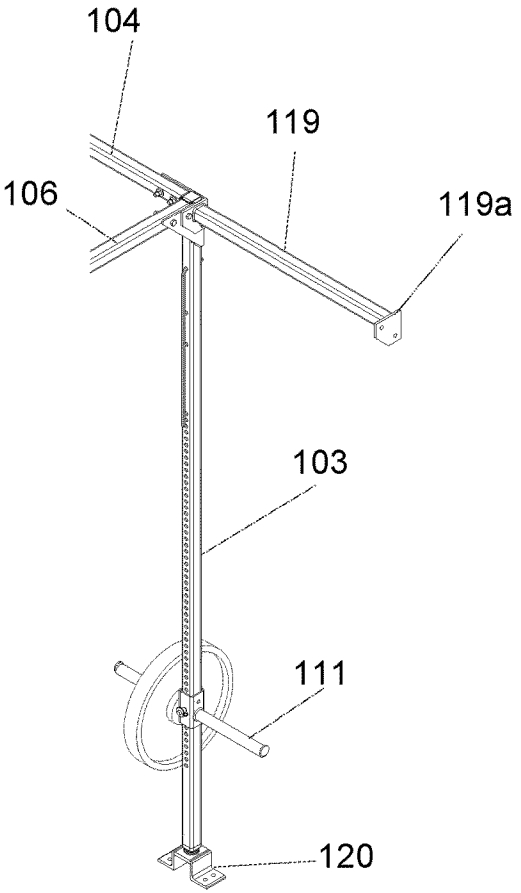
FIG. 5 shows a corner of the units of FIGS. 1 and 2 with hardware for fixedly connecting the units to a wall.
Figure 4:
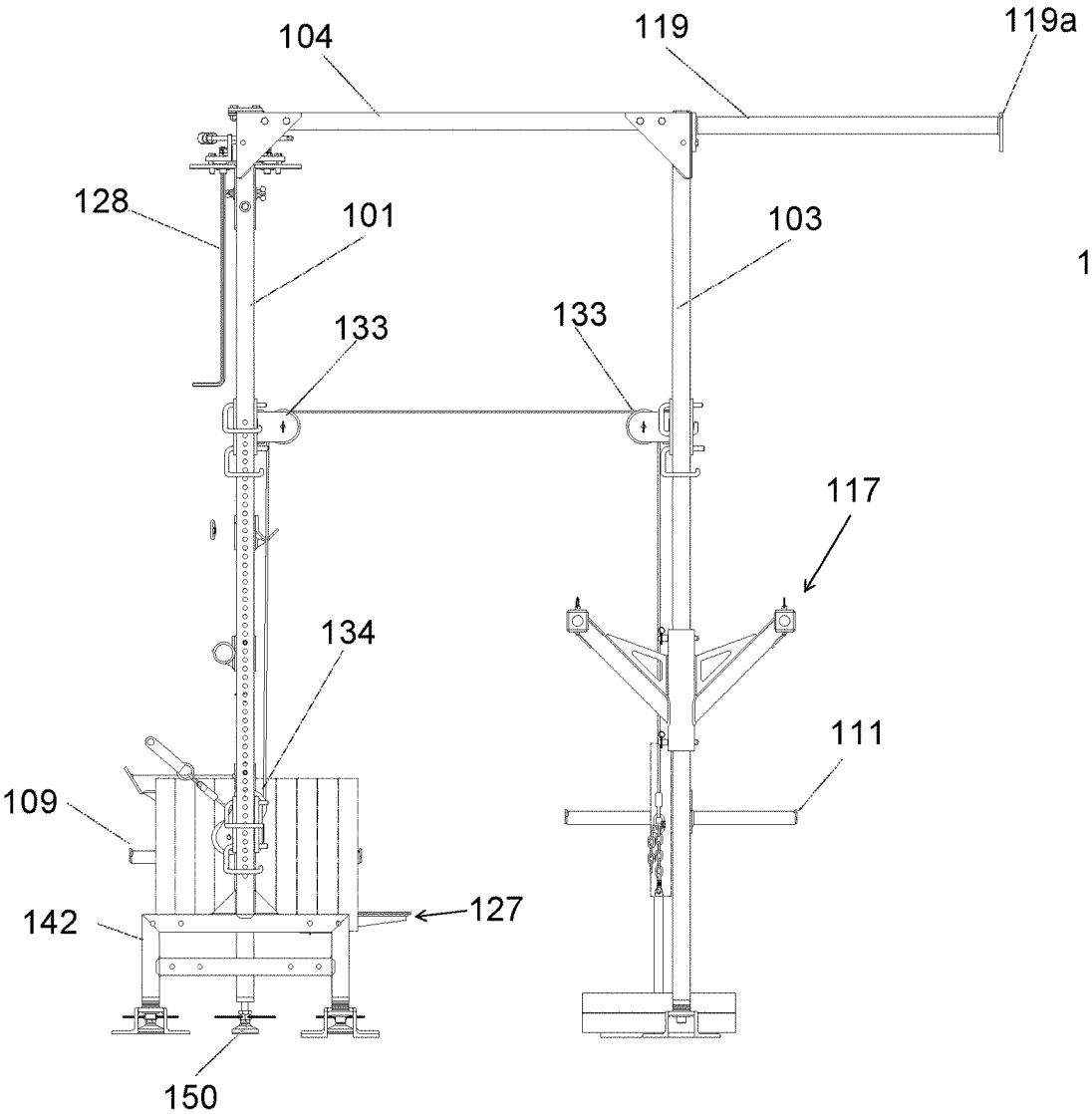
FIG. 4 show a side view of the example unit of FIG. 1.
Figure 7:
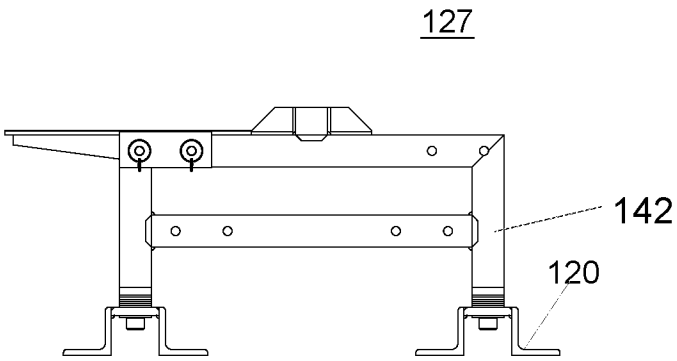
FIG. 7 shows a side view of an example bottom post stand.
Figure 6:
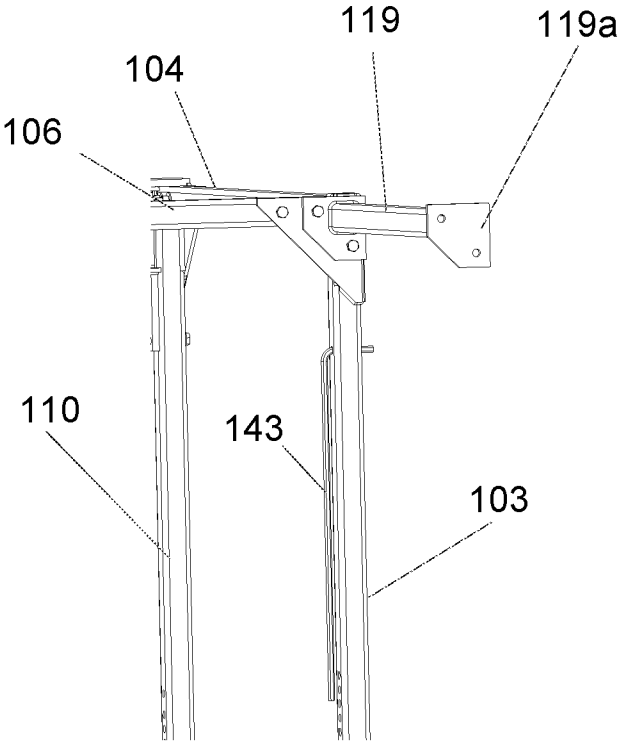
FIG. 6 shows another view of a corner of the units of FIGS. 1 and 2 with hardware for fixedly connecting the units to a wall.

FIG. 4 shows a side view of the embodiment 100 of FIG. 1, whereas FIGS. 5 and 6 show a corner view of that embodiment with detail for the wall bracket 119*a* that can be installed on a wall to stabilize the system. FIG. 7 shows a more detailed view of the side of the bench 127 with bottom post stand 142 and brackets 120.

FIG. 8 shows perspective view of an example embodiment of an extended system 200 using two separate units 100*b*, 100*c* configured together one in front of the other. The front unit 100*b* is basically the unit 100A shown in FIG. 2, but without wall mounting brackets 119*a* and with extension beams 119*c* replacing the mounting beams 119. The beams 119*c* then attach to front beams 105 of back unit 100*c*, which is similar to unit 100A of FIG. 1 but with the arrangement of components reversed right to left.

Note that alternative station assembly 117*a* is utilized on the left side of the extended system 200. Note also that when two units 100*b*, 100*c* are used, the front beam 105 of unit 100*c* is actually in the back of the assembled unit, and back beam 106 is in front of the front beam 105, as the two units are reversed in direction with respect to each other (i.e., rotated 108°), in the shown example. This allows exercise stations to be put on the outer circumference of the frame, rather than on an interior part, making access by users easier, and avoiding the need for users to be in an interior of the system cage.

Hence, extended system 200 shows that a modular system can be provided that enables at least a doubling of the number of potential stations for larger setups and for serving larger numbers of patients/trainees.

Figure 9:
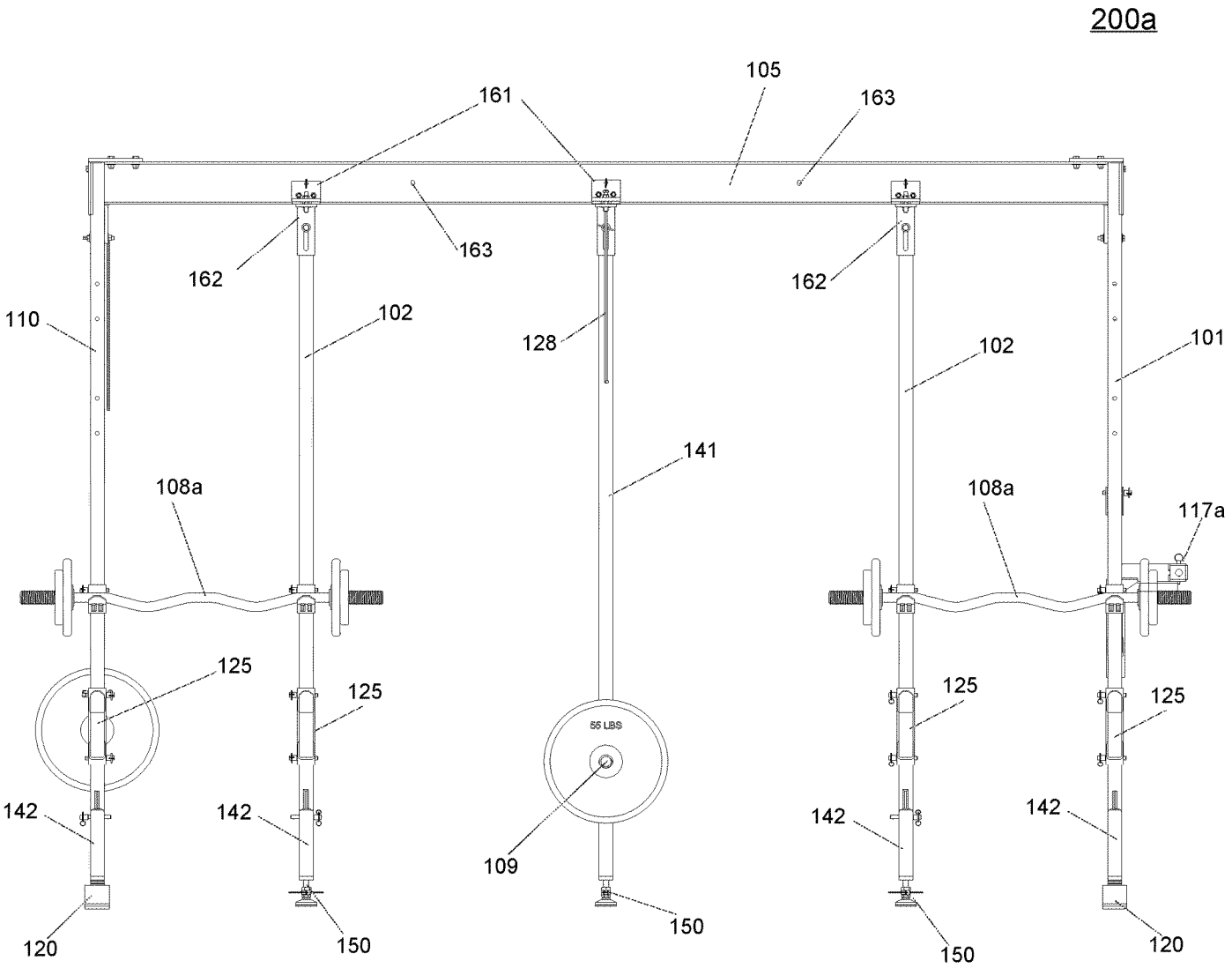
FIG. 9 is a front view of an example system comprising a pair of the units of FIG. 2 configured together to form a larger system having a pair of exercise stations using free weights.
Figure 10:
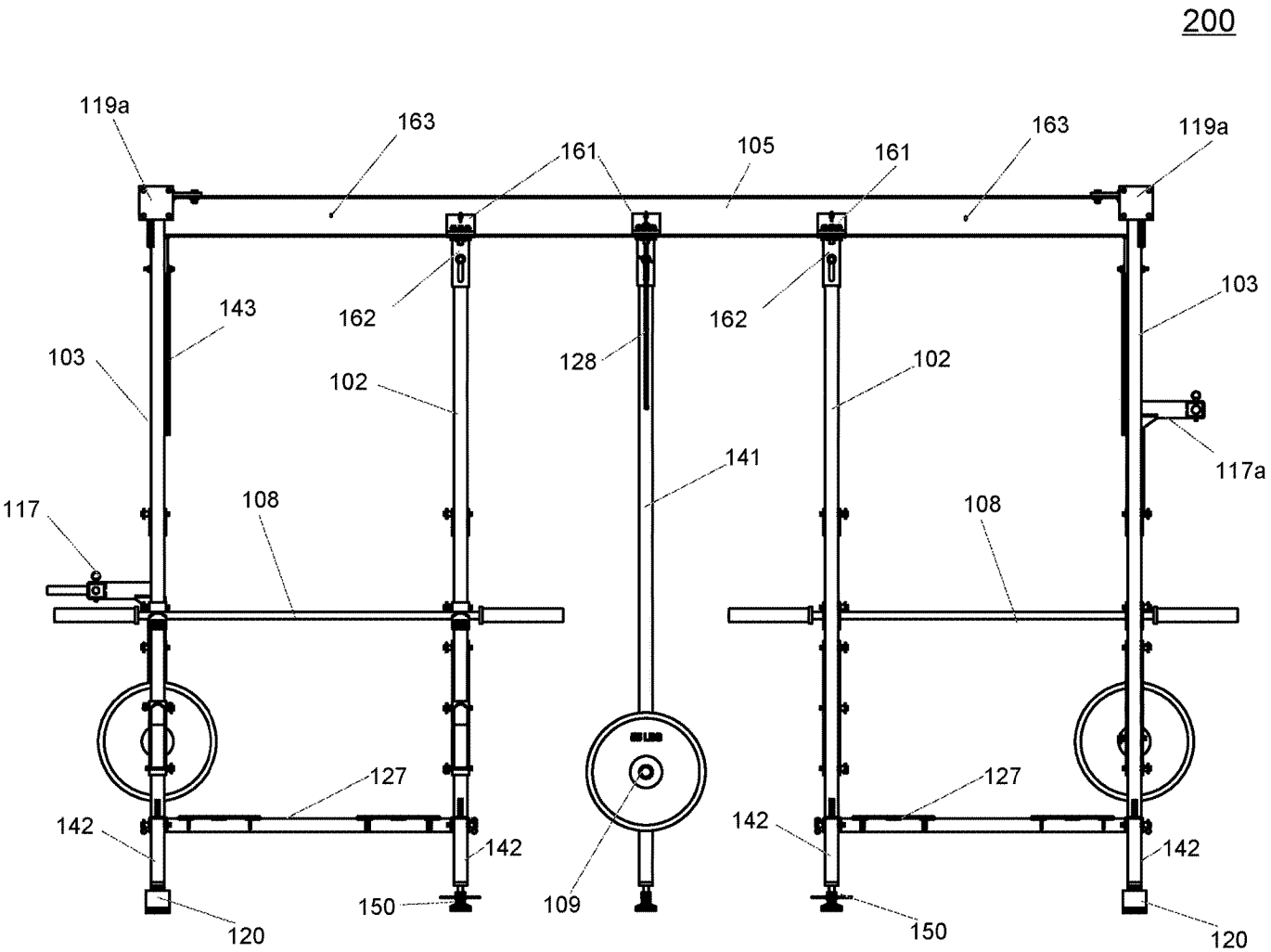
FIG. 10 is a back view of an example system comprising a pair of the units of FIG. 2 configured together to form a larger system.
Figure 11:
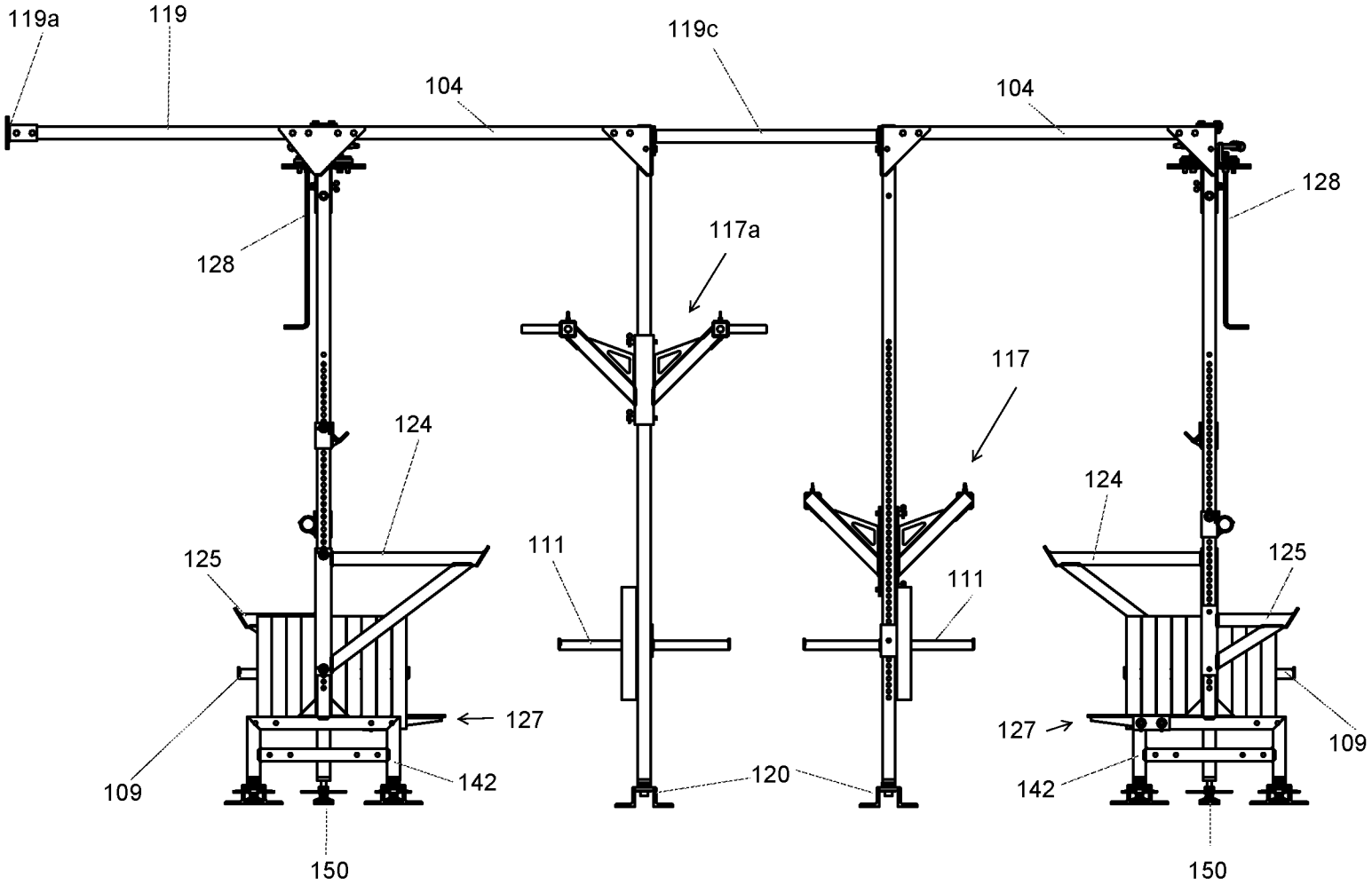
FIG. 11 is a side view of the example system of FIG. 8.

FIG. 9 shows a front view of an example extended system 200*a* that is modified from system 200 by adding a second free weight barbell system on the front with barbells 108*a*. FIG. 10 shows a back view of the system 200, whereas FIG. 11 shows a left side view of the system 200.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be necessary to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A system to provide training and/or a therapy to a plurality of participants, comprising:

a cage having a frame including:

a front beam, a back beam, a first side beam connected to said front beam and said back beam on one side of the cage, and a second side beam connected to said front beam and said back beam on another one side of the cage, a first front leg attached at or near a junction of said front beam and said first side beam, a second front leg attached at or near a junction of said front beam and said second side beam, at least one length adjustable sliding leg configured to support the cage on a surface and to slide horizontally along the front beam and be temporarily secured at one of a plurality of potential locations along that front beam; and at least one adjustable and movable exercise station configured to mount on one or more of said legs.

2. The system of claim 1, further comprising at least one wall mounting structure configured for securing said cage to a wall.

3. The system of claim 2, wherein said wall mounting structure includes a wall beam connected to said frame at a first end, and having a bracket configured for connecting to the wall at a second end.

4. The system of claim 3, wherein said wall mounting structure also includes a second wall beam connected to said frame at a first end, and having a second bracket for connecting to the wall at a second end.

5. The system of claim 4, wherein said first end of said wall beam and the first end of said second wall beam both connect at or near a junction of said first side beam with said back beam, and a junction of said second side beam with said back beam, respectively.

6. The system of claim 2, wherein said first front leg and said second front leg are configured to be fixedly attached to a floor.

7. The system of claim 6, wherein said first front leg and said second front leg are configured to be fixedly attached to a floor each via a separate post stand, each said post stand having at least two legs each configured to be separately fixedly attached to said floor.

8. The system of claim 6, said frame further comprising:

a first back leg connected at or near a junction of said first side beam with said back beam; and a second back leg connected at or near a junction of said second side beam with said back beam.

9. The system of claim 8, wherein said first back leg and said second back leg are configured to be fixedly attached to a floor.

10. The system of claim 1, said frame further comprising:

a first back leg connected at or near a junction of said first side beam with said back beam; and a second back leg connected at or near a junction of said second side beam with said back beam.

11. The system of claim 10, wherein said first back leg and said second back leg are configured to be fixedly attached to a floor.

12. The system of claim 1, further comprising a second sliding leg that has an adjustable length.

13. The system of claim 1, comprising a second adjustable and movable exercise station configured to mount on one or more of said legs, wherein said second exercise stations is configured to support a different exercise than another one of said at least one exercise station.

14. The system of claim 13, wherein at least one of said exercise stations is a station utilizing free weights.

15. The system of claim 13, wherein at least one of said exercise stations is a station for performing dip station/chin ups.

16. The system of claim 13, wherein at least one of said stations configurable with equipment for performing stationary biking, bent rows, and/or shoulder shrugs.

17. A method using the system of claim 1 for providing training and/or therapy to a plurality of participants, said method comprising the step of providing therapy or training to each one of said participants in a concurrent manner using said system with one or more therapists/trainers supporting said training/therapy.

18. The system of claim 1, further comprising a second cage configured to be placed adjacent to, and connected to, said first cage to increase the number of adjustable and movable exercise stations.

19. A system to provide training and/or a therapy to a plurality of participants, comprising:

a cage having a frame including:

a front beam, a back beam, a first side beam connected to said front beam and said back beam on one side of the cage, and a second side beam connected to said front beam and said back beam on another one side of the cage, a first back leg connected at or near a junction of said first side beam with said back beam, said first back leg being configured for fixedly connecting to a floor; and a second back leg connected at or near a junction of said second side beam with said back beam, said second back leg being configured for fixedly connecting to the floor;

a first front leg attached at or near a junction of said front beam and said first side beam, said first front leg being configured for fixedly connecting to the floor, a second front leg attached at or near a junction of said front beam and said second side beam said second front leg being configured for fixedly connecting to the floor, at least one pair of length adjustable sliding legs, each sliding leg being configured to support the cage on a surface and to slide horizontally along the front beam and be temporarily secured at one of a plurality of potential locations along that front beam;

at least one wall beam connected to said back beam, said at least one wall beam being configured for attaching to a wall; and a plurality of adjustable and movable exercise stations each configured to mount on one or more of said legs, wherein at least one of said adjustable and movable exercise stations is configured for a different exercise than another one of said adjustable and movable exercise stations.

20. The system of claim 19, further comprising a second cage configured to be placed adjacent to, and connected to, said first cage to increase the number of adjustable and movable exercise stations with an additional plurality of adjustable and movable exercise stations.

21. A method of providing training and/or a therapy to a plurality of participants, said method comprising the steps of:

providing a cage having a frame including:

a front beam, a back beam, at least one wall beam connected to said back beam, said at least one wall beam being configured for attaching to a wall, a first side beam connected to said front beam and said back beam on one side of the cage, and a second side beam connected to said front beam and said back beam on another one side of the cage, a first back leg connected at or near a junction of said first side beam with said back beam, said first back leg being configured for fixedly connecting to a floor; and a second back leg connected at or near a junction of said second side beam with said back beam, said second back leg being configured for fixedly connecting to the floor;

a first front leg attached at or near a junction of said front beam and said first side beam, said first front leg being configured for fixedly connecting to the floor, a second front leg attached at or near a junction of said front beam and said second side beam said second front leg being configured for fixedly connecting to the floor, at least one pair of length adjustable sliding legs, each sliding leg being configured to support the cage on a surface and to slide horizontally along the front beam and be temporarily secured at one of a plurality of potential locations along that front beam;

providing a plurality of adjustable and movable exercise stations each configured to mount on one or more of said legs, wherein at least one of said adjustable and movable exercise stations is configured for a different exercise than another one of said adjustable and movable exercise stations; and providing therapy and/or training to each one of said participants in a concurrent manner using said system with one or more therapists/trainers supporting said training/therapy.

* * * * *